US006834418B2

(12) United States Patent
Chiang

(10) Patent No.: US 6,834,418 B2
(45) Date of Patent: Dec. 28, 2004

(54) INTERLACING AIR NOZZLE

(75) Inventor: Chuan-Chin Chiang, Taipei Hsien (TW)

(73) Assignee: Bell New Ceramics, Co., Ltd., Taipei (TW)

( * ) Notice: Subject to any disclaimer, the term of this patent is extended or adjusted under 35 U.S.C. 154(b) by 133 days.

(21) Appl. No.: 10/374,986

(22) Filed: Feb. 28, 2003

(65) Prior Publication Data

US 2004/0195368 A1 Oct. 7, 2004

(51) Int. Cl.[7] ..... D02J 1/08
(52) U.S. Cl. ..... 28/274; 28/272
(58) Field of Search ..... 28/271, 272, 273, 28/274, 275, 276, 258, 283; 57/279, 280, 289, 350, 333, 908

(56) References Cited

U.S. PATENT DOCUMENTS 4,936,000 A * 6/1990 Nabulon et al. ..... 28/272
5,146,660 A * 9/1992 Ritter ..... 28/274
5,839,176 A * 11/1998 Lin ..... 28/272
5,964,015 A * 10/1999 Sear ..... 28/274
6,148,490 A * 11/2000 Bertsch ..... 28/272
6,163,944 A * 12/2000 Lin ..... 28/274
6,311,376 B1 * 11/2001 Hinchliffe et al. ..... 28/272
6,438,812 B1 * 8/2002 Jansen ..... 28/274

* cited by examiner

*Primary Examiner*—Amy B. Vanatta

(57) ABSTRACT

The invention provides an interlacing air nozzle for increasing the airtightness thereof, wherein the dual-leverage principle thereof enables front and rear top members to simultaneously move up and down, and the front top member is also capable of pressing horizontally downward without abrading the structure as a whole. The main body of the invention includes a front top member, a rear top member, a connection piece, a base, a front base, a sliding member and an airtight washer member. The airtight washer member that is flexible using a spring is provided within the front top member, and the up-and-down movements thereof are employed for horizontally pressing the sliding member having an air inlet and a yarning groove above, thereby increasing the airtightness and practical values thereof.

1 Claim, 5 Drawing Sheets

INTERLACING AIR NOZZLE

BACKGROUND OF THE INVENTION (a) Field of the Invention

The invention relates to an interlacing air nozzle, and more particularly, to a interlacing air nozzle that increase the airtightness of the yarn groove thereof, thereby evenly interlacing the yarn thereof without affecting the interlacing air nozzle with abrasion as a whole.

(b) Description of the Prior Art

Referring to FIG. 1 showing a conventional elevational view of a prior art for interlacing yarn; wherein a threading slot 11 having an opening at the top thereof is provided at the center of a blow pipe 1, and at the bottom center of the threading slot 11 of the blow pipe 1 is provided with an air inlet 13 in communication with a joint 12; a yarn 2 is placed into the threading slot 11 for interacting with the air inlet 13, such that airflow discharged from the threading slot 11 passes through the air inlet 13 and interlaces the yarn 2. However, such prior art has a defective design that causes environmental pollution and production cost wastage caused by the airflow discharged upward (as indicated by the arrow pointing upward FIG. 1) from the totally open blow pipe 1 when interlacing the yarn 2. In addition, airtightness of such prior art is unsatisfactory that the yarn 2 is weft unevenly with a poor quality.

Referring to FIGS. 2, 3 and 4 showing a conventional elevational view, a side view and an enlarged sectional view of another prior art interlacing the yarn 2 when opened and closed, respectively, a main body 3 therein comprises a top member 31 capable of up-and-down lifting and covering, and at the rear of the top member 31 is provided with an axis 311 connected with a base 35. The front bottom relative to the axis 311 is further provided with a tappet 312. On the base 35 is disposed with a sliding member 33 capable of sliding back and forth further provided with a sealing cover 32 for pressing against a groove A331. At the rear top of the sliding member 33 is disposed with a groove B322 for interacting with the tappet 312. In order to place the yarn 2 for interlacing, at the center of the sliding member 33 is disposed with a groove 331A further provided with an air inlet 333 at the center bottom thereof. At the bottom of the base is provided with a joint 34 in communication with the air inlet 333 for conducting injected airflow, and at the interior of the joint 34 is an air outlet 341. When the top member 31 moves up and down, the sliding member 33 displaces back and forth using the tappet 312 for placing the yarn 2. Moreover, the sliding groove bottom surface 335 of the sliding member 33 is abraded due to the sliding groove 334 provided at the bottom of the sliding member 33, as indicated by the abraded plane 336 in FIG. 4. When the sliding groove 334 is abraded and pressure is added at the jet air outlet 341, air leakage that causes unstable jet airflow is resulted (as indicated by the arrow in FIG. 4), thus bringing about uneven weaving and poor quality of yarn. Consequently, fabrics weaved from the yarn 2 are undesirable in quality and offers inadequate competitiveness. The aforesaid shortcomings have long since bothered industrialists and consumers, and therefore, it is a prime task to provide an interlacing air nozzle that maximizes the efficiency and practical values thereof.

SUMMARY OF THE INVENTION

An object of the invention is to provide an interlacing air nozzle, wherein the angle difference produced from closing a front top member thereof is capable of increasing tightness, and the dual-leverage principle thereof is utilized for simultaneously moving the front and rear top members up and down such that the front top member is horizontally pressed downward without wearing or abrading the structure as a whole.

The described technical shortcoming of the prior art is mainly due to the abrasion of the sliding member thereof, and uneven interlacing of the yarn resulted from an air leakage caused by the unsatisfactory tightness when covered during processing. For solving the problem, the invention provides a technical method, wherein parallel lug shoulders having twin peaks are provided at the top of the base, the front and rear lugs thereof are provided with a connection piece that connects the front and rear lugs and the bottom portions of the rear and front top members for forming a dual lever. In addition, the front top member is provided with a flexible spring and an airtight washer member, such that the airtight washer member is fixed at a sliding member disposed at the top of the front base for moving up and down and horizontally pressing downward.

The angle difference produced from closing the structure according to the invention increases the tightness thereof, the dual-leverage principle thereof enables the front and rear top members to simultaneously move up and down while the structure as a whole is also capable of horizontally pressing downward. The airtight washer member is able to move and up and down without abrading the structure, and the spring adds further airtightness to the airtight washer member.

DETAILED DESCRIPTION OF THE PREFERRED EMBODIMENTS

Figure 1:
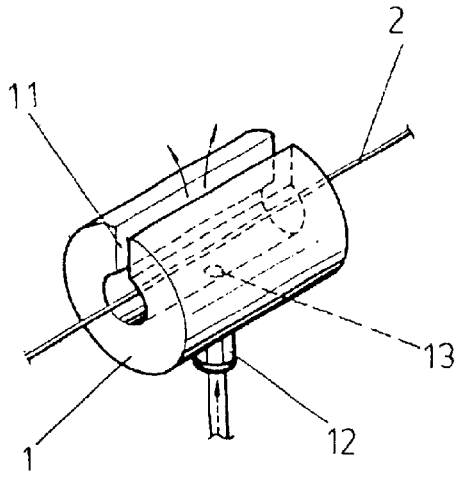
FIG.1 Prior Art
FIG. 1 shows a conventional elevational view of a prior art interlacing yarn.
Figure 2:
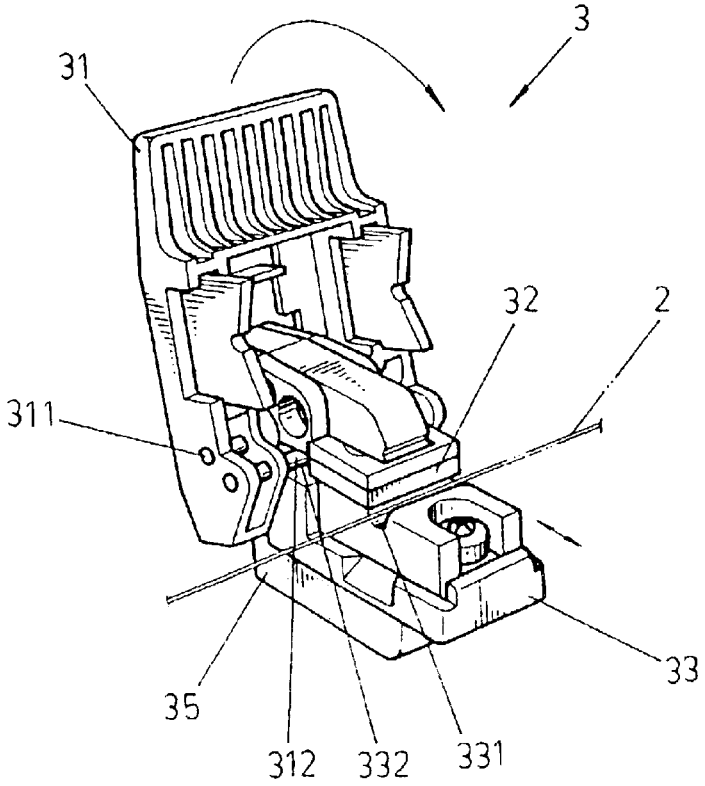
FIG.2 Prior Art
FIG. 2 shows a conventional elevational view of another prior art interlacing yarn (when opened).
Figure 3:
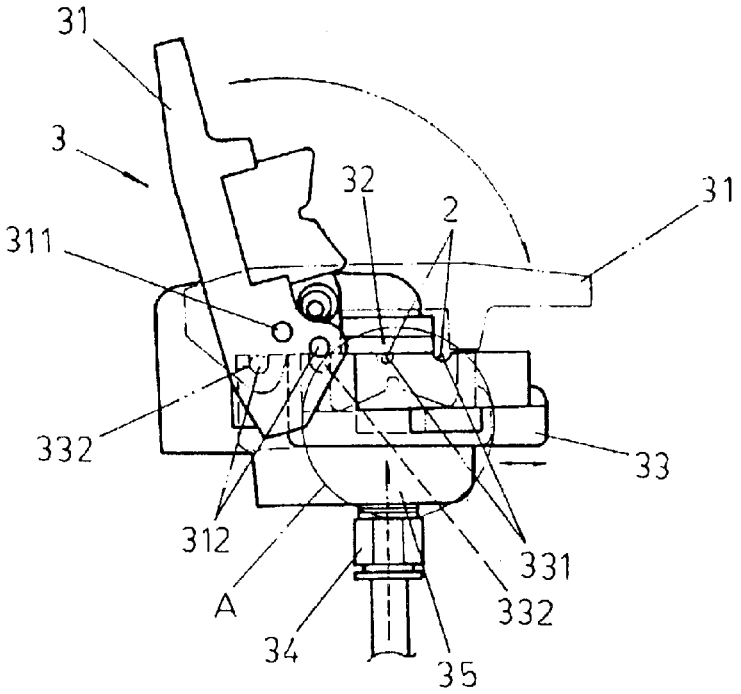
FIG.3 Prior Art
FIG. 3 shows a side view of the prior art in FIG. 2 when closed and opened.
Figure 4:
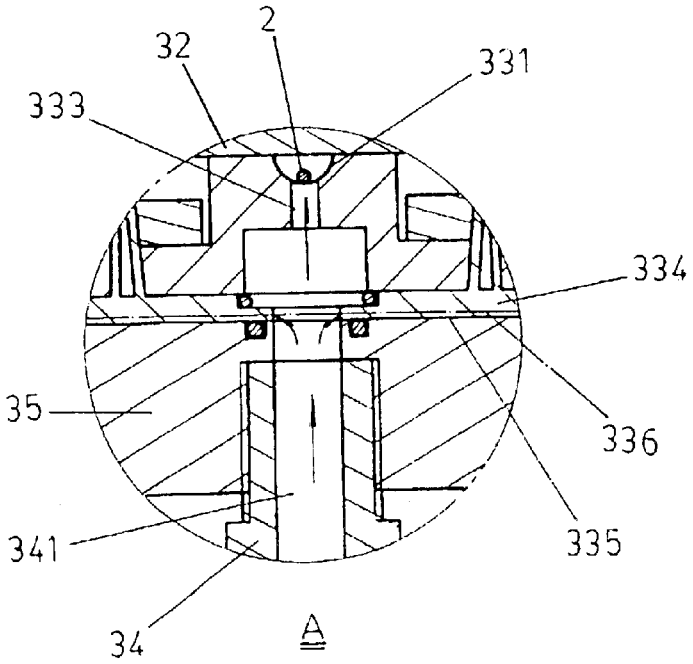
FIG.4 Prior Art
FIG. 4 shows a partial enlarged view of A in FIG. 3.
Figure 5:
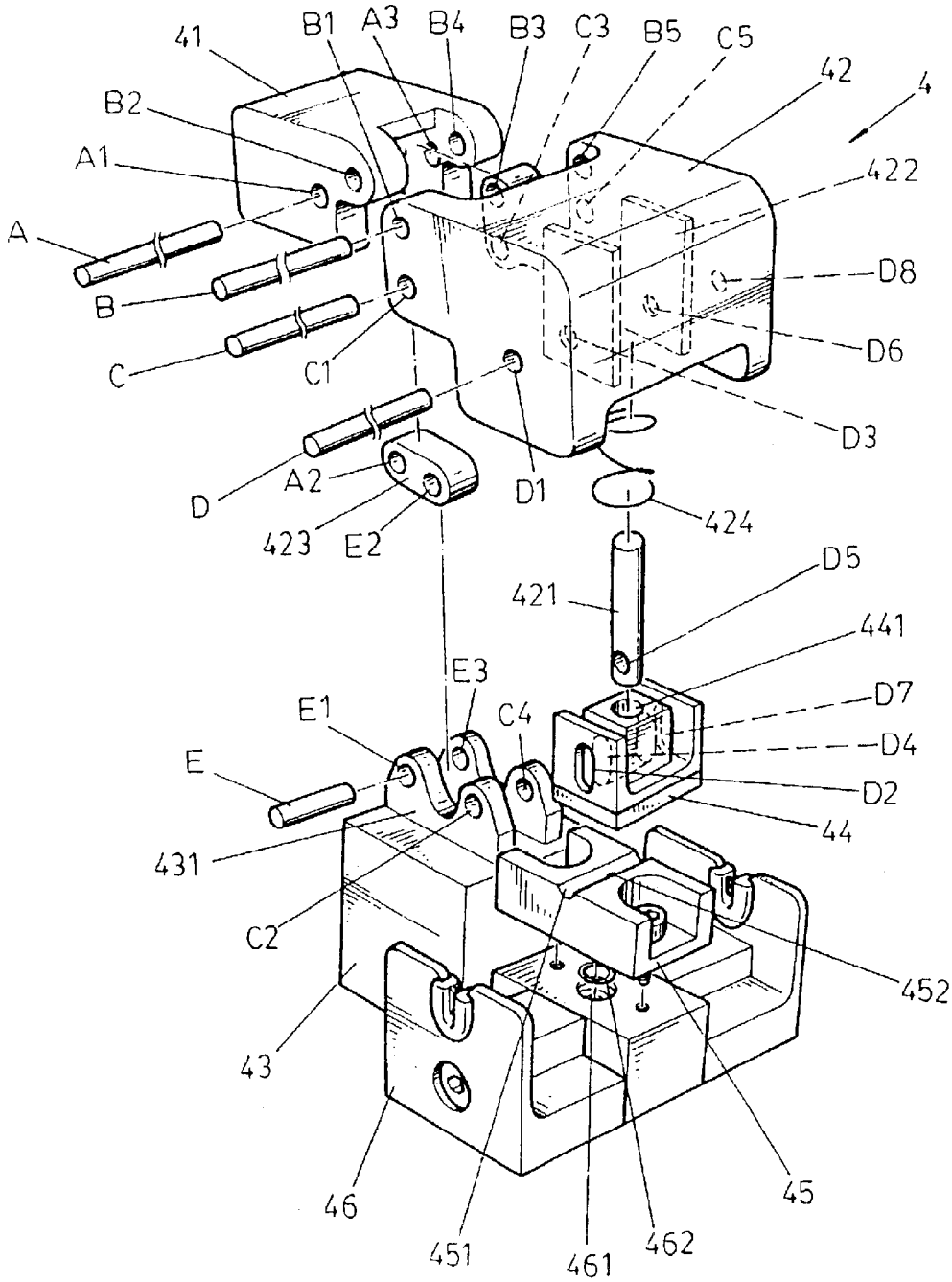
FIG. 5 shows an exploded elevational view in accordance with the invention.
Figure 6:
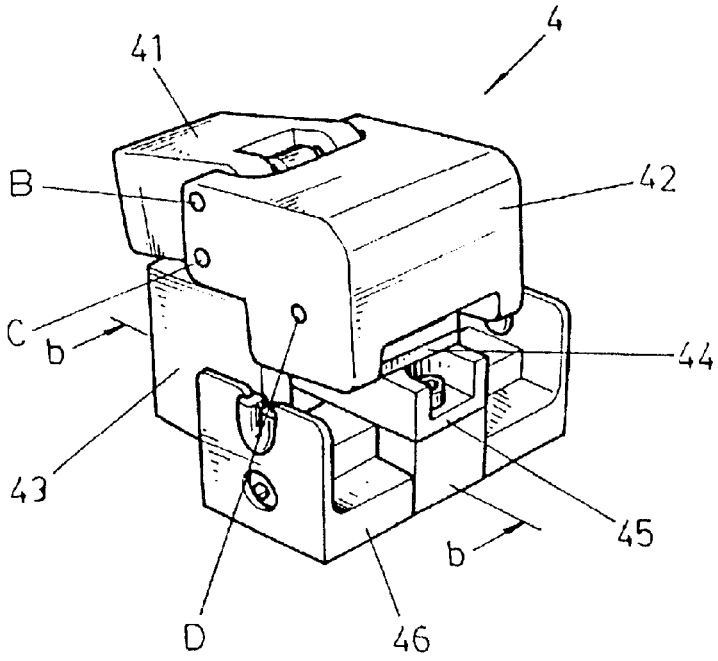
FIG. 6 shows an elevational view in accordance with the invention (when closed).
Figure 9:
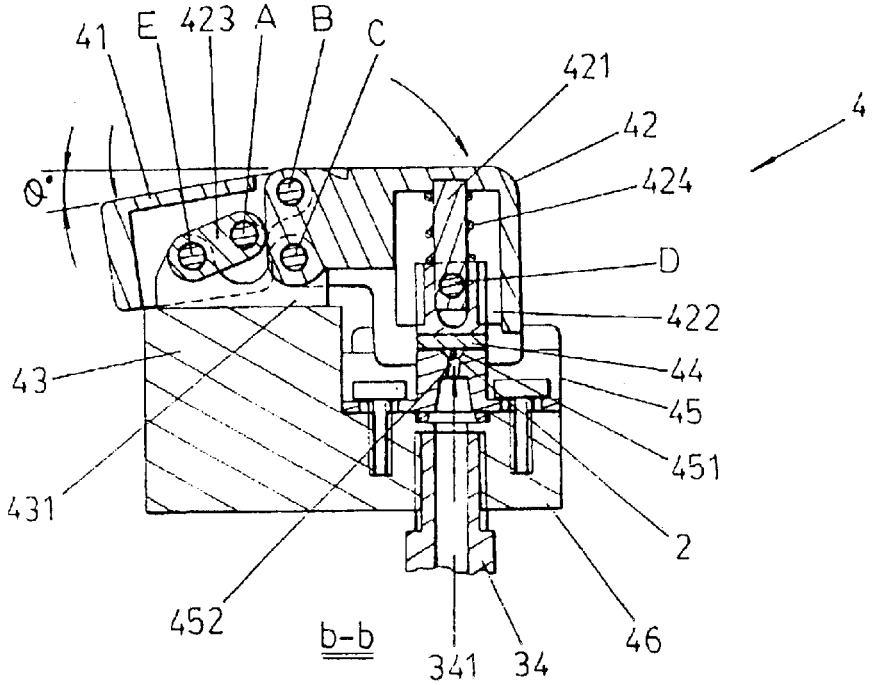
FIG. 9 shows a sectional view in accordance with the invention (when closed).

Referring to FIGS. 5, 6 and 9 showing an exploded elevational view (when closed), an elevational view (when closed) and a sectional view according to the invention, respectively, a main body 4 thereof comprises a front top member 42, a rear top member 41, a connection piece 423, a base 43, a front base 46, a sliding member 45, and an airtight washer member 44. Wherein, at the top of the base 43 is provided with a two parallel lug shoulders 431 having twin peaks, and the lug shoulders 431 are further disposed with corresponding orifices E1, E3, C2 and C4, respectively. The rear lugs of the parallel lug shoulders 431 are for inserting the connection piece 423 having orifices A2 and E2 and connecting the orifices E1, E2 and E3 in sequence. One end provided with an orifice A2 of the connection piece 423 is for embedding between the right and left orifices A1 and A3 and into the center of the rear top member 41 and for connecting through the orifices A1, A2 and A3 using an axis A. The rear top member 41 is U-shaped and has orifices B2 and B4 at the two front sides thereof, respectively. The front top member 42 is W-shaped provided with corresponding orifices B1, B3, B5, C1, C3 and C5 at the left, center, and right, wherein the upper portion of the front top member 42 is for embedding the U-shaped rear top member 41 in the front using a B axis in sequence. The B axis is also used for inserting through and connecting the orifices B1, B2, B3, B4 and B5 in sequence. Two bottom sidewalls of the front top member 42 are for coordinating with the front lugs of the parallel lug shoulders 431 at the base 43 such that a C axis is employed for connecting the orifices C1, C2, C3, C4 and C5 in sequence to form a dual-lever. In order to increase the airtightness and buffer effect of the airtight washer member 44, two parallel guide plates 422 are provided within the front top member 42, and at the center of the front top member 42 and the guiding plates 422 are provided with orifices D1, D3, D6 and D8 from left to right, respectively, for embedding and connecting the W-shaped airtight washer member 44 above. Also, up-and-down flexibility and airtightness are provided, for that the axis 421 disposed between the two guiding plates 422 is provided with an orifice D5 at the bottom portion thereof, the W-shaped airtight washer member 44 above is provided with orifices D2, D4 and D7 from left to right, the center of the W-shape is for inserting the axis 421 having the orifice D5, the two guiding plates 422 are inserted for entering between the two sides of the W-shaped air washer 44 above, the front top member 42 is fastened by inserting through the orifices D1, D2, D3, D4, D5, D6, D7 and D8 in sequence using an axis D, and the axis 421 is further provided with a compression spring 424 for pressing the airtight washer member 44 downward. At the front of the base 43 is provided with a front base 461 further provided with an airtight washer 462 that secures the sliding member 45 at the top thereof by means of a screw. The sliding member 45 is situated relatively below the airtight washer member 44 and is provided with an air inlet 452 and a yarn groove 451 at the center thereof for sliding and interlacing the yarn 2.

Figure 7:
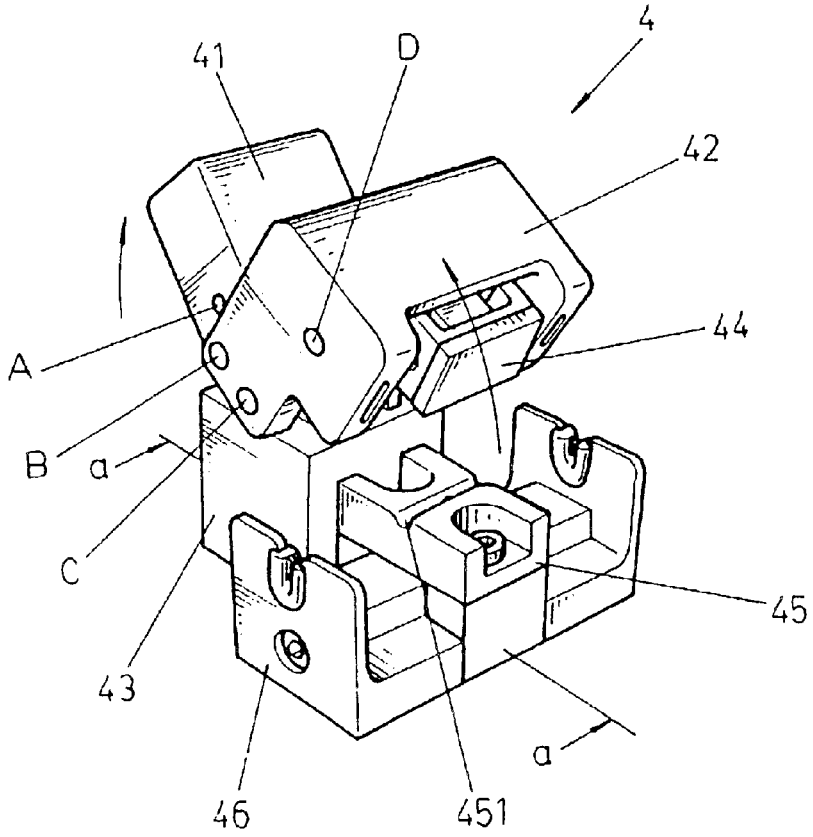
FIG. 7 shows an elevational view in accordance with the invention (when opened).
Figure 8:
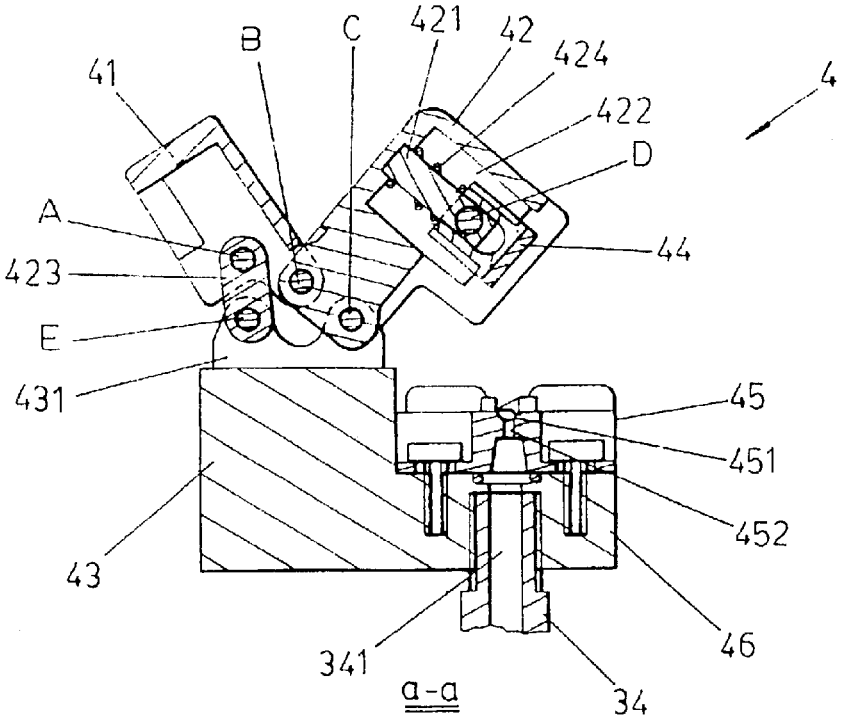
FIG. 8 shows a sectional view in accordance with the invention (when opended).

Referring to FIGS. 7, 8 and 9 showing an elevational view when opened, an sectional view when opened, and a sectional view when closed in accordance with the invention, respectively, a dual-leverage structure is formed by the front top member 42, the rear top member 41, the connection piece 423 and the parallel lug shoulders 431 having twin peaks, and therefore the front and rear top members 42 and 41 are able to simultaneously move up and down. To have the front top member 42 horizontally pressed downward, only the rear top member 41 from the front and rear top members 42 and 41 in a V-shaped arrangement need to be pressed downward. An angle difference produced from closing (as the angle Q indicated in FIG. 9) increases the tightness thereof, such that the front top member 42 cannot be opened while also horizontally pressing downward, and consequently the airtightness as whole is raised. In addition, up-and-down movements of the airtight washer member 44 are accomplished through the axis 421, and therefore the fixed sliding member situated below helps preventing the sliding member from being abraded as well as leakage. The yarn 2 is enveloped tightly within the yarn groove 451 to have the air inlet 452 evenly interlace the yarn 2, and the airtight washer member 44 moves up and down for adjustment by pressing downward. To open the front top cover 42, only the rear top member 41 needs to be triggered upward (as shown in FIG. 9), then the front top member 42 impels the rear top member upward simultaneously due to the dual-leverage principle thereof, and the yarn may be drawn out from the yarn groove 451 at the top of the sliding member 45.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An air interlacing nozzle for increasing the airtightness thereof, wherein a dual-leverage principle provided enables front and rear top members thereof to simultaneously move up and down and to further impel the front top member for pressing horizontally downward, such that the nozzle remains unaffected by abrasion as a whole; a main body thereof comprises a front top member, a rear top member, a connection piece, a base, a front base, a sliding member and an airtight washer member; wherein in the front of the base is provided with a front base further provided with a screw opening and oil seal for screwing and fastening a joint having a jet air inlet, and above the front base is disposed with the sliding member further provided with a yarn groove for placing yarn and an air inlet for injecting the jet airflow thereof; and the characteristics thereof are that at the top of the base is disposed with parallel lug shoulders having rear lugs thereof connected to the bottom portion of the rear top member using the provided connection piece and the lugs thereof connected to the rear bottom portion of the front top member using a provided axis, and thus the top portions of the rear and front top members form a dual-lever by the provided axis; in addition, two guiding plates and an axis having a spring are disposed within the front top member so that the airtight washer member is formed by a W-shape member with the two inner sides and the center thereof embedded and inserted into the provided axis through orifices, such that the airtight washer member moves up and down and presses downward with the fixed sliding member, thereby increasing the airtightness thereof.

* * * * *